US007850166B2

(12) United States Patent
Ichimura

(10) Patent No.: US 7,850,166 B2
(45) Date of Patent: Dec. 14, 2010

(54) SHEET DELIVERY/GUIDE APPARATUS

(75) Inventor: Shoichi Ichimura, Ibaraki (JP)

(73) Assignee: Komori Corporation, Tokyo (JP)

( * ) Notice: Subject to any disclaimer, the term of this patent is extended or adjusted under 35 U.S.C. 154(b) by 252 days.

(21) Appl. No.: 12/069,982

(22) Filed: Feb. 13, 2008

(65) Prior Publication Data

US 2008/0191404 A1 Aug. 14, 2008

(30) Foreign Application Priority Data

Feb. 14, 2007 (JP) ..... 2007-033074

(51) Int. Cl.
*B65H 29/34* (2006.01)

(52) U.S. Cl. ..... 271/189; 271/204; 271/218; 271/309; 271/176

(58) Field of Classification Search ..... 271/189, 271/204, 218
See application file for complete search history.

(56) References Cited

U.S. PATENT DOCUMENTS 5,433,429 A * 7/1995 Muller ..... 271/189
5,493,104 A * 2/1996 Wilson ..... 235/98 R
5,582,400 A * 12/1996 Seydel ..... 271/176
5,707,058 A * 1/1998 Hirth et al. ..... 271/176
6,273,417 B1 * 8/2001 Berlingen et al. ..... 271/183

FOREIGN PATENT DOCUMENTS

JP 63282041 A * 11/1988
JP 2004-217343 A 8/2004
JP 2006-036511 A 2/2006

* cited by examiner

*Primary Examiner*—Saúl J Rodríguez
*Assistant Examiner*—Luis Gonzalez
(74) *Attorney, Agent, or Firm*—Blakely, Sokoloff, Taylor & Zafman

(57) ABSTRACT

In a sheet delivery/guide apparatus, a sheet released from a convey device and falling piles on a first pile device. A first blowing device is arranged above the first pile device and blows toward the first pile device. An air controller selectively performs switching between an air supply state and an air supply stop state of the first blowing device for the sheet. A guide member is supported movably and guides the sheet that passes the first pile device while being held by the convey device. A guide member switching unit switches the guide member between a guide position to enter a sheet falling path, extending from the convey device to the first pile device, to guide the sheet, and a retreat position to retreat from the sheet falling path. A controller controls the air controller and the guide member switching unit on the basis of a convey speed of the convey device. Thus, in a first mode in which the sheet piles on the first pile device, the air supply state of the first blowing device for the sheet is effected and the guide member is positioned at the retreat position. In a second mode in which the sheet passes the first pile device and is conveyed downstream in a sheet convey direction, the air supply stop state of the first blowing device for the sheet is effected and the guide member is positioned at the guide position.

13 Claims, 8 Drawing Sheets

GUIDE MEMBER 25
GUIDE RETREAT
T2

GUIDE SOLENOID VALVE 31
ON
OFF
t2
C1

FAN SHIELDING PLATE 22
CLOSE
OPEN
T1

SHIELDING PLATE SOLENOID VALVE 23
ON
OFF
t1
B1

SHEET RELEASE CAM SOLENOID VALVE 11
ON
OFF
A1

GUIDE MEMBER 25
GUIDE RETREAT
T2

GUIDE SOLENOID VALVE 31
ON
OFF
C2

FAN SHIELDING PLATE 22
CLOSE
OPEN
T1

SHIELDING PLATE SOLENOID VALVE 23
ON
OFF
B2

SHEET RELEASE CAM SOLENOID VALVE 11
ON
OFF
A1

FIG.6A
FIG.6B
FIG.6C
FIG.6D
FIG.6E
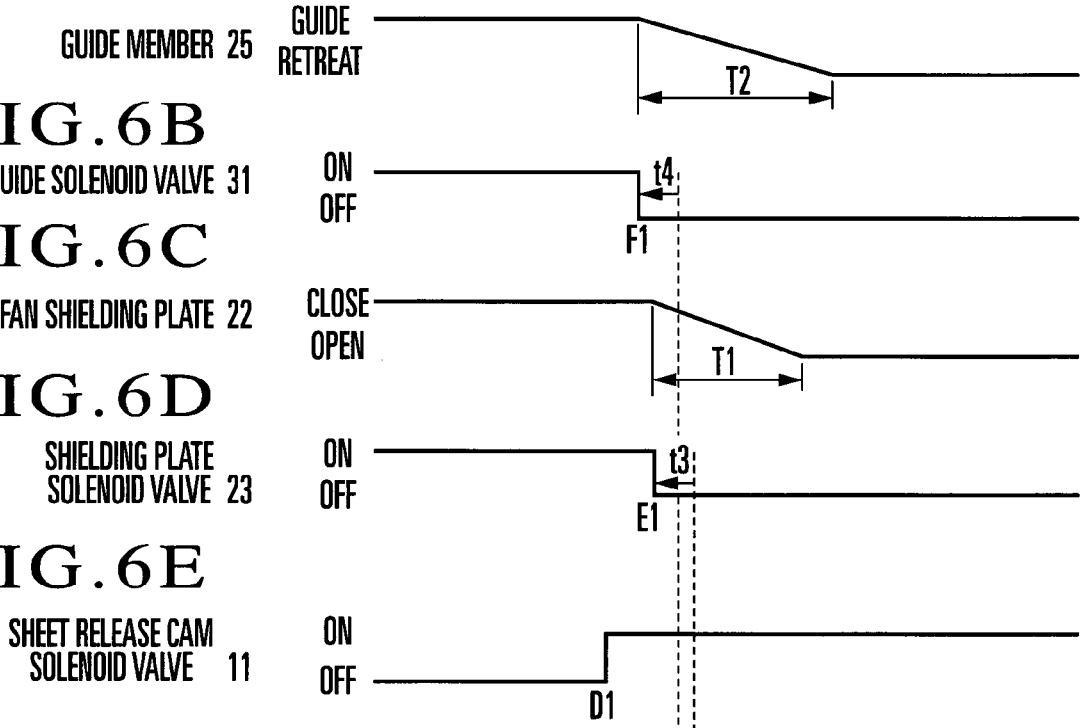
FIG.7A
FIG.7B
FIG.7C
FIG.7D
FIG.7E
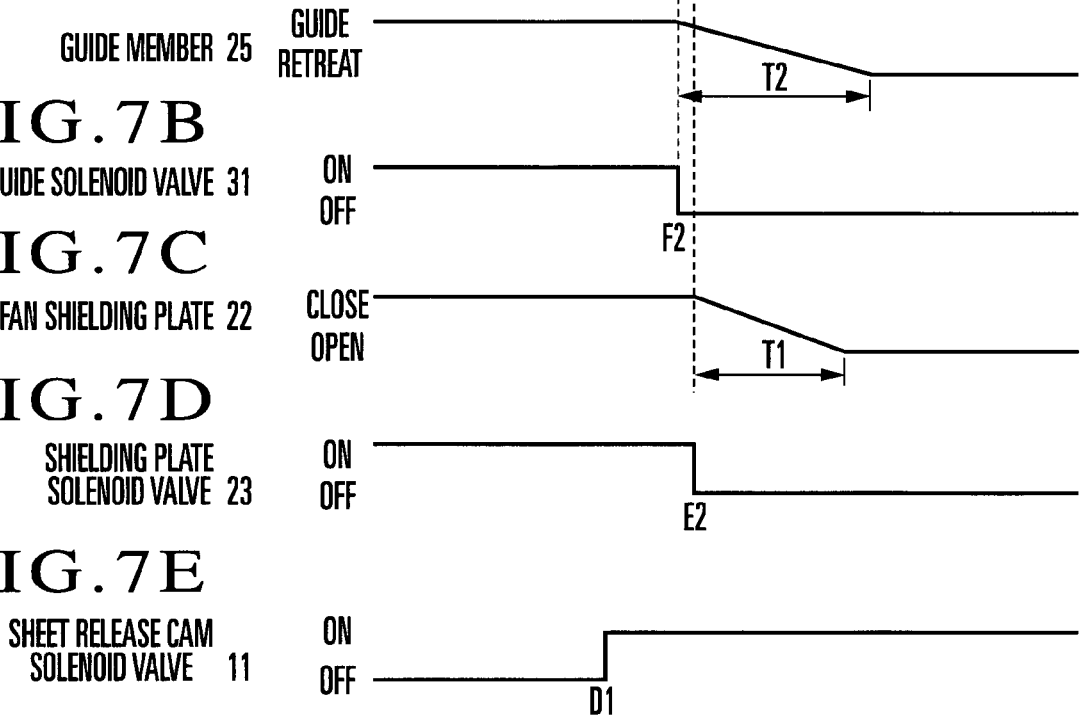

SHEET DELIVERY/GUIDE APPARATUS

BACKGROUND OF THE INVENTION

The present invention relates to a sheet delivery/guide apparatus in a sheet-fed rotary printing press or the like, which performs switching between piling and non-piling (passing) of sheets onto a sheet pile device.

Conventionally, as shown in Japanese Patent Laid-Open No. 2006-36511, a sheet delivery/guide apparatus has been proposed which comprises a pile device on which sheets conveyed by a sheet convey means pile, and a sheet guide means which can move between a guide position where the sheet guide means moves forward above the pile device to guide a passing sheet downstream in the sheet convey direction and a retreat position where the sheet guide means retreats from the guide position and a sheet released from the sheet convey means falls onto the pile device.

As shown in Japanese Patent Laid-Open No. 2004-217343, a sheet delivery/guide apparatus has been proposed which comprises a pile device on which sheets conveyed by a sheet convey means pile, a fan provided above the pile device and blows air to a sheet so that the sheet released from the sheet convey means reliably falls onto the pile device, and a shielding device which closes the intake port of the fan so as to regulate blowing air toward a sheet passing above the pile device.

Each conventional sheet delivery/guide apparatus described above must control the timing when the sheet is released from the sheet convey means, the timing when the sheet guide means moves, and the timing when the fan blows air. When the sheet convey speed increases, however, the time interval between sheets decreases relatively. In this case, if the timing when the sheet guide means moves or the timing when the fan blows air or stops blowing air is controlled after the sheet piles on the pile device completely or passes the pile device completely, the next sheet control operation will be delayed.

When the switching timing is set on the basis that the sheet convey speed is high, if the convey speed decreases, the guide member undesirably moves to the guide position before the sheet piles on the pile device. Accordingly, a sheet which is to pile on the pile device undesirably rides over the sheet guide means. In particular, assume that the driving means for the sheet guide means or for the fan shielding device is an air cylinder. In this case, the operation speed of the air cylinder is constant regardless of the sheet convey speed. The air cylinder thus cannot cope with a change in sheet convey speed, causing the problems described above.

SUMMARY OF THE INVENTION

It is an object of the present invention to provide a sheet delivery/guide apparatus which optimally controls the timing when the guide member moves and the timing when the blower blows air or stops blowing air when the sheet convey speed is switched from a low speed to a high speed or vice versa.

In order to achieve the above object, according to the present invention, there is provided a sheet delivery/guide apparatus comprising a convey device which holds and conveys a sheet, a first pile device on which the sheet released from the convey device and falling piles, a first blowing device which is arranged above the first pile device and blows toward the first pile device, air control means for selectively performing switching between an air supply state and an air supply stop state of the first blowing device for the sheet, a guide member which is supported movably and guides the sheet that passes the first pile device while being held by the convey device, guide member switching means for switching the guide member between a guide position to enter a sheet falling path, extending from the convey device to the first pile device, to guide the sheet, and a retreat position to retreat from the sheet falling path, and control means for controlling the air control means and the guide member switching means on the basis of a convey speed of the convey device, so that in a first mode in which the sheet piles on the first pile device, the air supply state of the first blowing device for the sheet is effected and the guide member is positioned at the retreat position, and in a second mode in which the sheet passes the first pile device and is conveyed downstream in a sheet convey direction, the air supply stop state of the first blowing device for the sheet is effected and the guide member is positioned at the guide position.

BRIEF DESCRIPTION OF THE DRAWINGS

FIGS. 6A to 6E are timing charts of the switching operation from the second pile to the first pile when printing speed>preset speed;

FIGS. 7A to 7E are timing charts of the switching operation from the second pile to the first pile when printing speed≦preset speed;

DESCRIPTION OF THE PREFERRED EMBODIMENTS

A sheet delivery/guide apparatus according to the first embodiment of the present invention will be described with reference to FIGS. 1 to 7. In the first embodiment, a delivery/guide apparatus in a sheet processing machine will be exemplified by a delivery apparatus in a sheet-fed rotary printing press.

Figure 1:
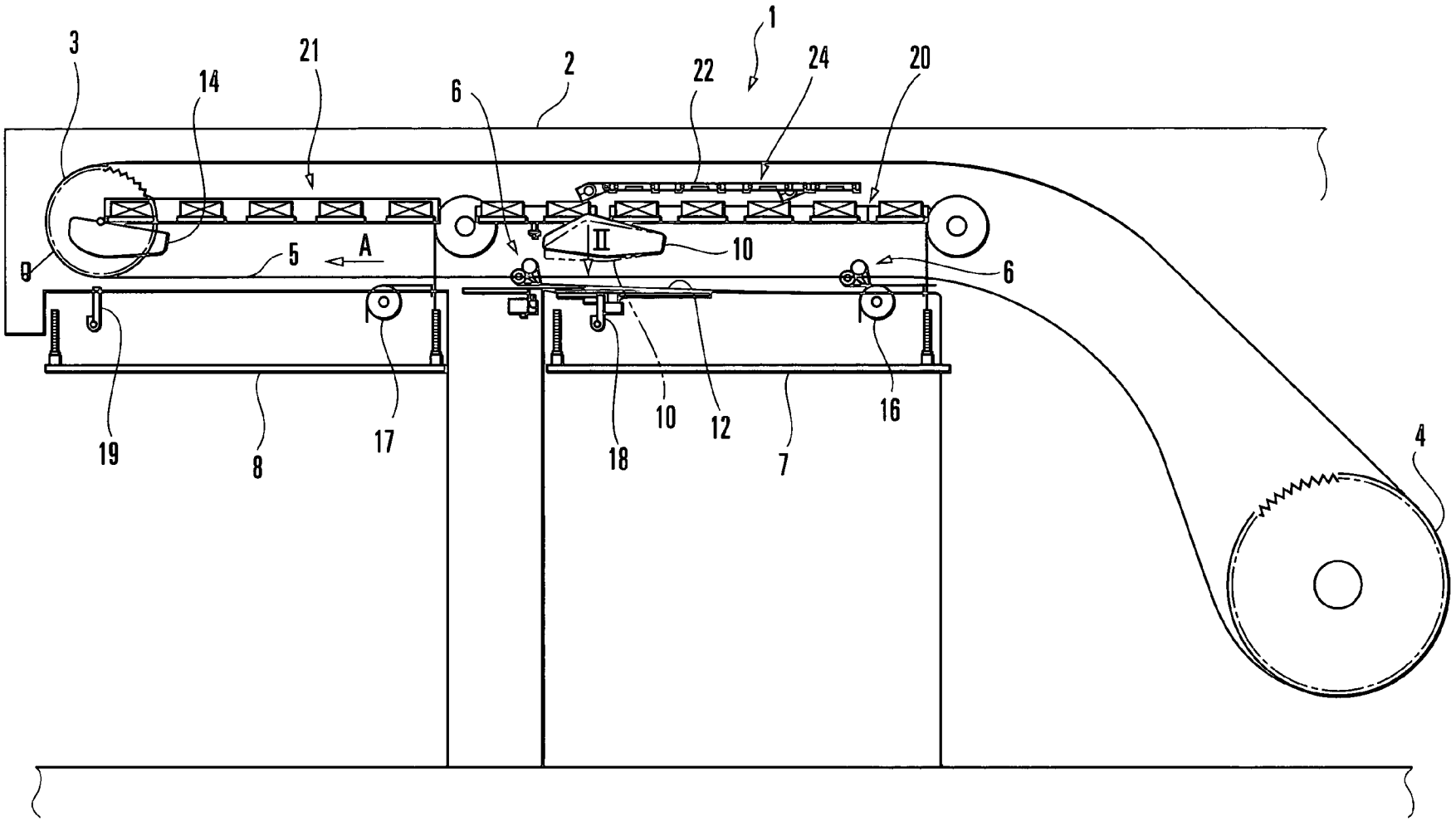
FIG. 1 is a schematic side view of a sheet delivery/guide apparatus according to the first embodiment of the present invention.

As shown in FIG. 1, a delivery apparatus 1 of a sheet-fed rotary printing press comprises a pair of delivery frames 2 which oppose each other at a predetermined gap. A pair of sprockets 3 are rotatably supported at the rear ends of the upper portions of the delivery frames 2.

Delivery chains 5 serving as a pair of traveling bodies traveling in the direction of an arrow A are looped between the pair of sprockets 3 and a pair of sprockets 4 coaxial with a delivery cylinder (not shown) serving as a sheet transport cylinder which opposes the last printing cylinder. Gripper bars each having a plurality of delivery grippers 6 (holding means) for gripping and conveying a sheet 12 are supported between the pair of delivery chains 5 at predetermined intervals in the traveling direction of the delivery chains 5. The pair of sprockets 3, pair of sprockets 4, pair of delivery chains 5, and plurality of delivery grippers 6 at least constitute a convey means. FIG. 1 illustrates only one of the pair of sprockets 3, one of the pair of sprockets 4, and one of the pair of delivery chains 5.

Figure 3:
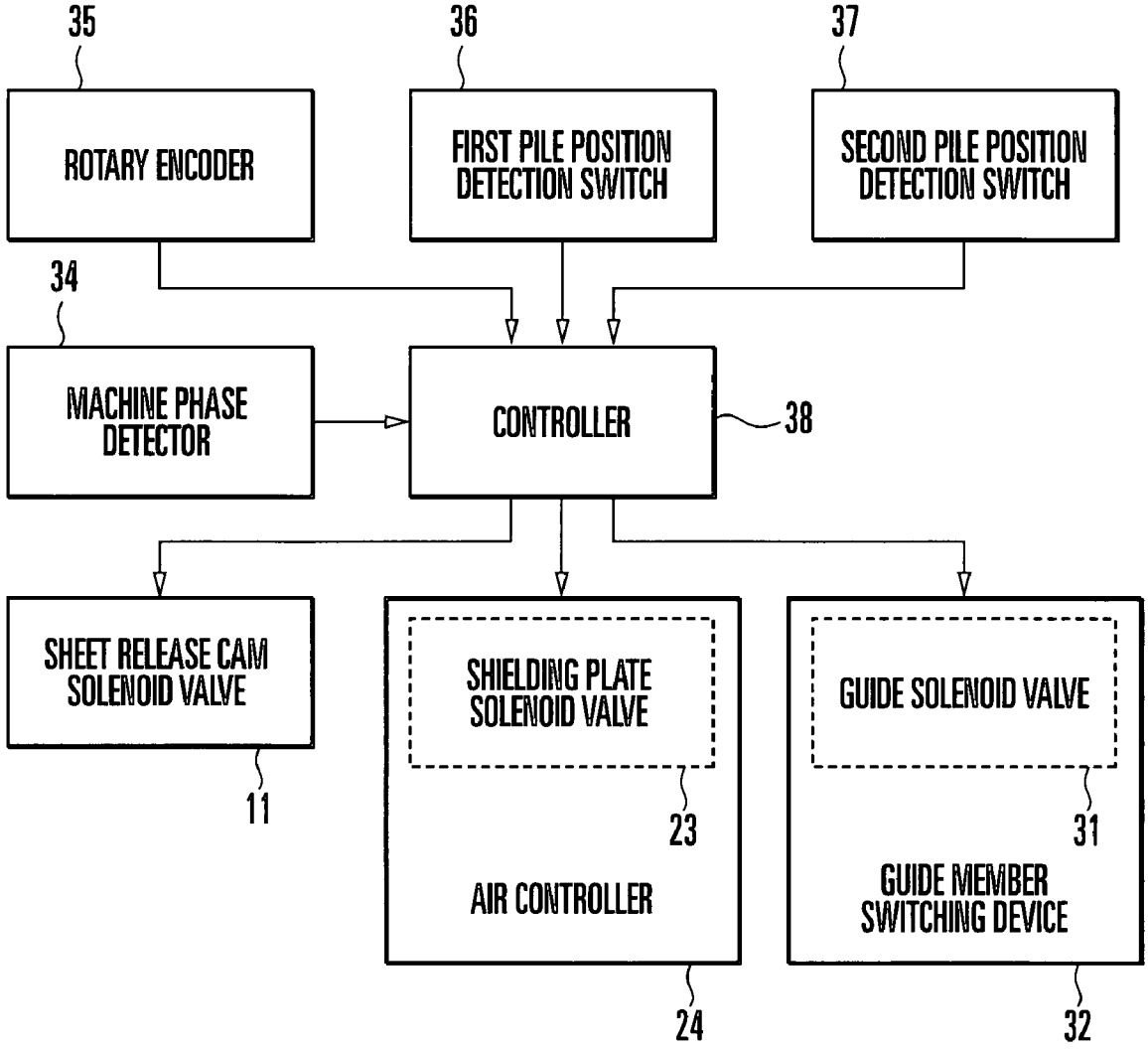
FIG. 3 is a block diagram showing the electrical arrangement of the sheet delivery/guide apparatus shown in FIG. 1.

A first pile 7 and second pile 8 are sequentially disposed as sheet pile devices along the sheet convey direction. Hence, the first pile 7 is arranged most upstream in the sheet convey direction to serve as the most-upstream pile means. A movable sheet release cam 10 (opening means) which causes the delivery grippers 6 to release the sheet 12 is arranged above the first pile 7. When a sheet release cam solenoid valve 11 (switching means) shown in FIG. 3 is turned on, the rod of an air cylinder (not shown) serving as an actuator moves forward, so the cam surface of the movable sheet release cam 10 enters the traveling path of the corresponding gripper bar as indicated by an alternate long and two short dashed line in FIG. 1. Thus, the cam follower of the gripper bar with the delivery grippers 6 abuts against the cam surface of the movable sheet release cam 10. The sheet 12 gripped by the delivery grippers 6 is thus released and falls onto the first pile 7. The sheet release cam solenoid valve 11 and the air cylinder (not shown) constitute a moving means for moving the movable sheet release cam 10. This moving means also serves as a switching means (to be described later) for switching the sheet convey state.

The state in which the sheet 12 released from the delivery grippers 6 falls onto the first pile 7 will be called the first mode hereinafter. When the sheet release cam solenoid valve 11 is turned on, the rod of the air cylinder (not shown) moves backward, and the movable sheet release cam 10 retreats from the traveling path of the corresponding delivery grippers 6, as indicated by a solid line in FIG. 1. In the state in which the movable sheet release cam 10 has retreated from the traveling path, when the gripper bar passes the movable sheet release cam 10, the cam follower of the gripper bar does not abut against the movable sheet release cam 10. Hence, the sheet 12 gripped by the delivery grippers 6 is not delivered onto the first pile 7 but passes the first pile 7, is conveyed downstream in the sheet convey direction (direction of the arrow A), that is, to a portion above the second pile 8, and falls onto the second pile 8. The state in which the sheet 12 gripped by the delivery grippers 6 passes the first pile 7 and is conveyed to the second pile 8 will be called the second mode hereinafter.

A stationary sheet release cam 14 is provided above the second pile 8. As shown in FIG. 1, the cam surface of the stationary sheet release cam 14 constantly enters the traveling path of the corresponding gripper bar having the delivery grippers 6. Accordingly, in the second mode in which the sheet 12 gripped by the delivery grippers 6 does not fall onto the first pile 7 but is conveyed to the second pile 8, the cam follower of the gripper bar having the delivery grippers 6 abuts against the cam surface of the stationary sheet release cam 14. Thus, the sheet 12 gripped by the delivery grippers 6 is released and falls onto the second pile 8.

Suction wheels 16 and 17 (sheet decelerating means) which grip the sheet 12 are arranged upstream in the sheet convey direction respectively above the first and second piles 7 and 8. The suction wheels 16 and 17 grip with air the trailing edge of the sheet 12 released from the delivery grippers 6 to decelerate the convey speed of the sheet 12. Thus, the speed with which the sheet 12 abuts against lays (to be described late) is reduced to an appropriate value, thus preventing an alignment error in the traveling directions of the sheets 12. Lays 18 and 19 (aligning means) against which the leading edge of the sheet 12 released from the delivery grippers 6 abuts are arranged downstream in the sheet convey direction respectively above the first and second piles 7 and 8. Each of the lays 18 and 19 swings periodically to come into contact with and separate from the edge of the sheet on the corresponding one of the first piles 7 and 8, thus aligning the traveling directions of the sheets 12 that fell and piled on each of the first and second piles 7 and 8.

First and second blowers 20 and 21 each comprising a large number of fans directed to the corresponding one of the first and second piles 7 and 8 are arranged above the first and second piles 7 and 8, respectively. When air from each of the first and second blowers 20 and 21 blows the sheet 12 released from the delivery grippers 6, the sheet 12 quickly falls onto the corresponding one of the first and second piles 7 and 8 and piles there.

The air intake port of the first blower 20 is provided with a separable fan shielding plate 22 (shielding member). When a fan shielding plate solenoid valve 23 (see FIG. 3) is turned on, the rod of an air cylinder (not shown) serving as an actuator moves forward, so the fan shielding plate 22 comes into contact with the air intake port of the first blower 20 to shield it. Shielding of the air intake port stops air from the first blower 20 for the sheet 12 gripped by the delivery grippers 6 and passing above the first pile 7.

When the fan shielding plate solenoid valve (to be referred to as the shielding plate solenoid valve hereinafter) 23 is turned off, the rod of the air cylinder (not shown) moves backward, and the fan shielding plate 22 separates from the air intake port of the first blower 20 to open the air intake port. The fan shielding plate 22, the shielding plate solenoid valve 23, and the air cylinder (not shown) constitute an air controller 24 which switches instantaneously between an air supply state (a state in which the sheet is blown with air) and air supply stop state (a state in which the sheet is not blown with air) of the first blower 20 for the sheet 12.

Figure 2:
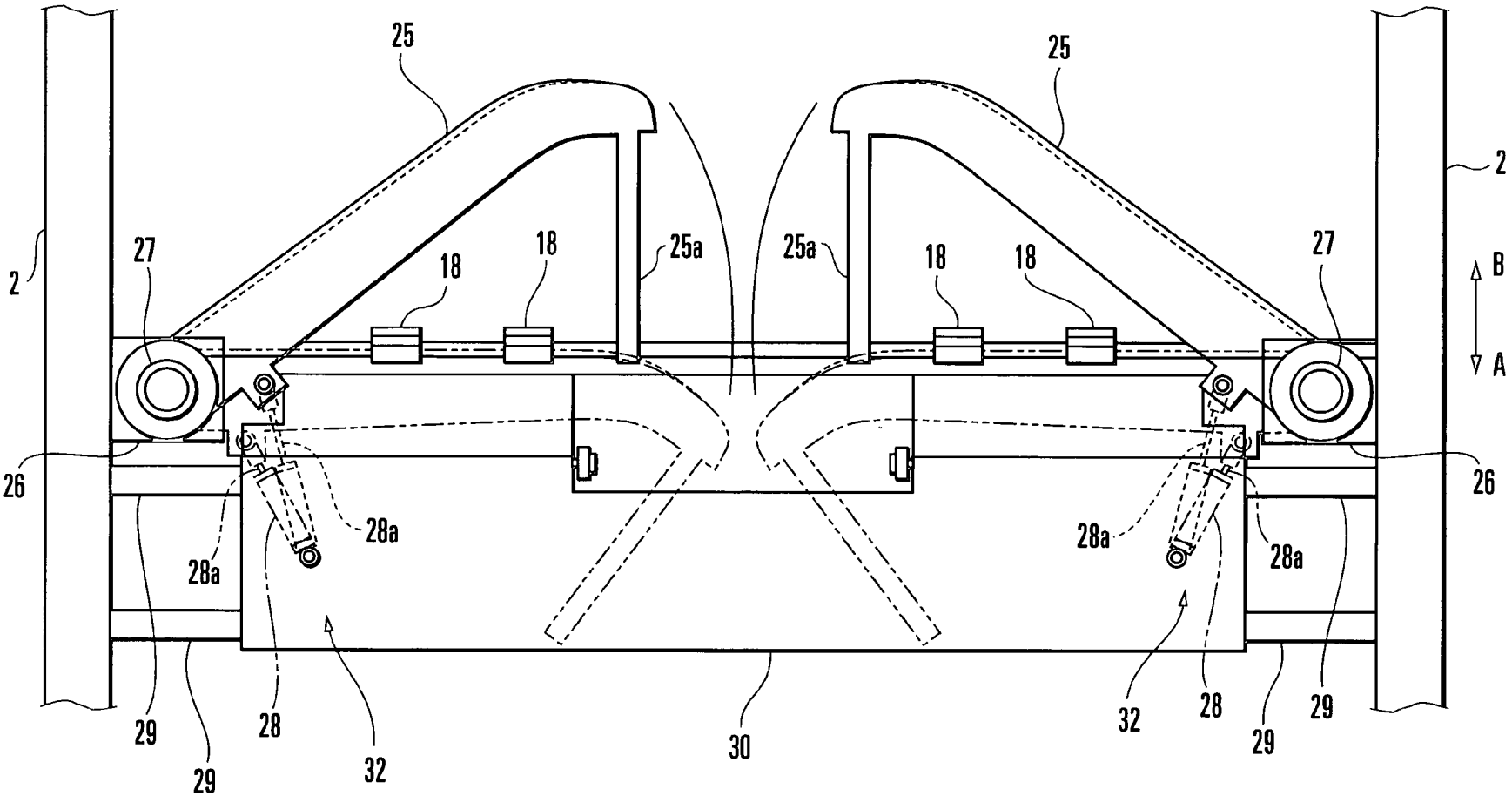
FIG. 2 is a view seen from the arrow II in FIG. 1.

A pair of guide members 25 having free end portions are arranged in the vicinities of the lays 18. As shown in FIG. 2, the proximal end portions of the guide members 25 are pivotally supported through shafts 27 by a pair of seats 26 attached inside the pair of delivery frames 2. The distal ends of the free end portions of the guide members 25 which extend from the free end portions within the widthwise direction of the sheet are provided with extending portions 25*a* extending downstream in the sheet convey direction.

The cylinder ends of air cylinders 28 serving as hydropneumatic cylinders that drive the pair of guide members 25 are pivotally mounted on a stationary sheet guide 30 which is attached to the pair of delivery frames 2 through stays 29. The distal end portions of rods 28*a* of the air cylinders 28 are pivotally mounted on the proximal end portions of the guide members 25, that is, portions close to the shafts 27.

When a guide solenoid valve 31 (FIG. 3) is turned on, the rods 28*a* of the air cylinders 28 move forward, and then the guide members 25 pivot counter-sheet-convey direction (direction of an arrow B) about the shafts 27 as the pivot centers, as indicated by solid lines in FIG. 2. Hence, the guide members 25 move forward to a guide position above the lays 18 and above the first pile 7, where they guide the sheet 12 downstream in the sheet convey direction. This prevents the sheet 12 passing the first pile 7 from coming into contact with other sheets on the first pile 7, the lays 18, or support members which support the lays 18. This also prevents the sheet from fluttering or moving uncontrollably, thus enabling stable sheet conveyance.

When the guide solenoid valve 31 is turned off, the rods 28*a* of the air cylinders 28 move backward, and then the guide members 25 pivot in the sheet convey direction (direction of an arrow A) about the shafts 27 as the pivot centers, as indicated by alternate long and two short dashed lines in FIG. 2. Hence, the guide members 25 retreat downstream in the sheet convey direction from the position above the first pile 7 and move to a retreat position.

Therefore, the air cylinders 28 and guide solenoid valve 31 constitute a guide member switching device 32 which moves the guide members 25 between the guide position where the guide members 25 are positioned in the falling path of the sheet 12 falling from the delivery grippers 6 onto the first pile 7, and guide the sheet 12 passing the first pile 7, and the retreat position where the guide members 25 are retreated from the falling path of the sheet 12.

FIG. 3 shows the electrical arrangement of the sheet delivery/guide apparatus. Referring to FIG. 3, a controller 38 is connected to the sheet release cam solenoid valve 11, the air controller 24 including the fan shielding plate solenoid valve 23, and the guide member switching device 32 including the guide solenoid valve 31 (described above). In addition, the controller 38 is also connected to a machine phase detector 34 which detects the phase of the printing press, a rotary encoder 35 (speed detection means) which detects the printing speed, that is, the rotational speed of the printing press, a first pile position detection switch 36 which detects the position of the first pile 7, and a second pile position detection switch 37 which detects the position of the second pile 8.

The pile position detection switches 36 and 37 respectively detect that the first and second piles 7 and 8 which move downward as the sheets 12 pile on them reach the lower limits corresponding to the full pile state of the sheets 12. The controller 38 controls the sheet release cam solenoid valve 11, shielding plate solenoid valve 23, and guide solenoid valve 31 upon reception of signals from the machine phase detector 34, rotary encoder 35, and pile position detection switches 36 and 37.

The ON/OFF timings of the movable sheet release cam 10, fan shielding plate solenoid valve 23, and guide solenoid valve 31 which are controlled by the controller 38 will be described with reference to FIGS. 4A to 4E, 5A to 5E, 6A to 6E, and 7A to 7E. FIGS. 4A to 4E and 6A to 6E show the case of "printing speed>preset speed", and FIGS. 5A to 5E and 7A to 7E show the case of "printing speed≦preset speed".

First, the timings in a case in which piling of the sheets 12 on the first pile 7 switches to that on the second pile 8 will be described with reference to FIGS. 4A to 4E and 5A to 5E. When the printing speed is equal to or lower than the preset speed (FIGS. 5A to 5E), the sheet release cam solenoid valve 11 switches from ON to OFF at a phase A1 (FIG. 5E), and the movable sheet release cam 10 retreats from the traveling path of the delivery grippers 6, thus switching to the second mode.

Figures 4A, 4B, 4C, 4D, 4E, 5A, 5B, 5C, 5D, 5E:
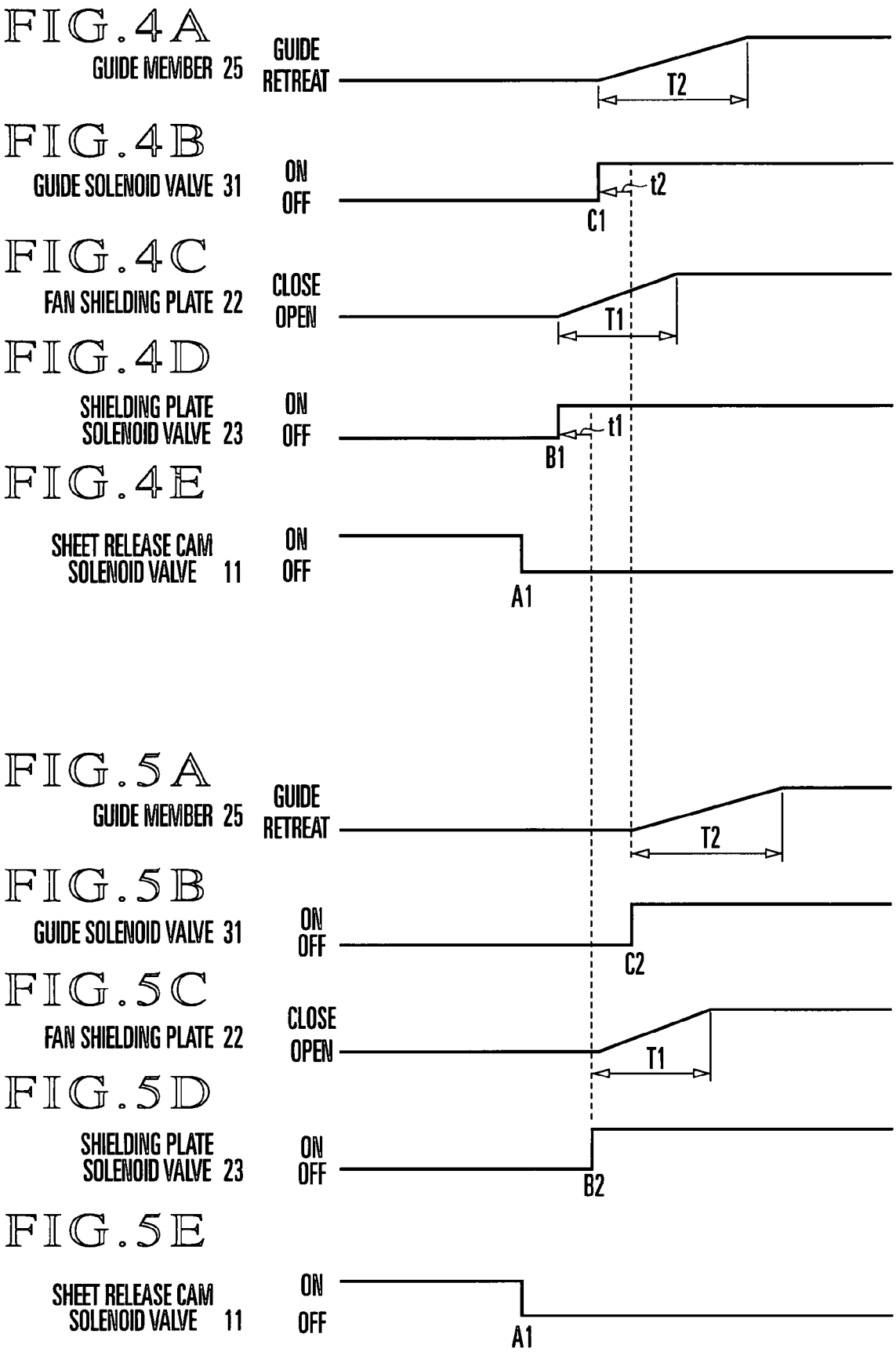
FIGS. 4A to 4E are timing charts of the switching operation from the first pile to the second pile when printing speed>preset speed.
FIGS. 5A to 5E are timing charts of the switching operation from the first pile to the second pile when printing speed≦preset speed.

The fan shielding plate solenoid valve 23 switches from OFF to ON at a phase B2 delayed from the phase A1 (FIG. 5D). Then, the fan shielding plate 22 shields the open air intake port of the first blower 20 while taking a time T1 since the phase B2 (FIG. 5C). The guide solenoid valve 31 switches from OFF to ON at a phase C2 delayed from the phase B2 (FIG. 5B). The guide members 25 move from the retreat position to the guide position while taking a time T2 (T2>T1) since the phase C2 (FIG. 5A).

The times T1 and T2 are the operation times (times required since the start till the completion of the operations) of the fan shielding plate actuator (not shown) and guide member actuator (not shown). When the actuators are hydro-pneumatic cylinders, the operation times are specific values determined by the characteristics of the cylinders, and are constant regardless of the printing speed. Thus, the sheet 12 can pass above the guide members 25 without being blown with the wind from the first blower 20, so that its fluttering or uncontrollable motion is prevented.

When the printing speed is no longer than the preset speed (FIGS. 4A to 4E), the sheet release cam solenoid valve 11 switches from ON to OFF at the same phase A1 as in FIG. 5E (FIG. 4E), and the movable sheet release cam 10 retreats from the traveling path of the delivery grippers 6, thus switching to the second mode. The fan shielding plate solenoid valve 23 switches from OFF to ON at a phase B1 which is delayed from the phase A1 and earlier than the phase B2 in FIG. 5D by a time t1 (FIG. 4D). Thus, the fan shielding plate 22 shields the open air intake port of the first blower 20 at a timing earlier by the time t1 than in the case in which the printing speed is equal to or lower than the preset speed, while taking the time T1 since the phase B1 (FIG. 4C).

The operation time T1 of the fan shielding plate actuator (not shown) is constant regardless of the printing speed. Hence, to actuate the fan shielding plate at a timing that matches the printing speed, the operation start period of the fan shielding plate actuator (not shown) is adjusted (to be advanced when the speed increases), thereby completing the operation of the fan shielding plate actuator at the right timing.

Figure 9:
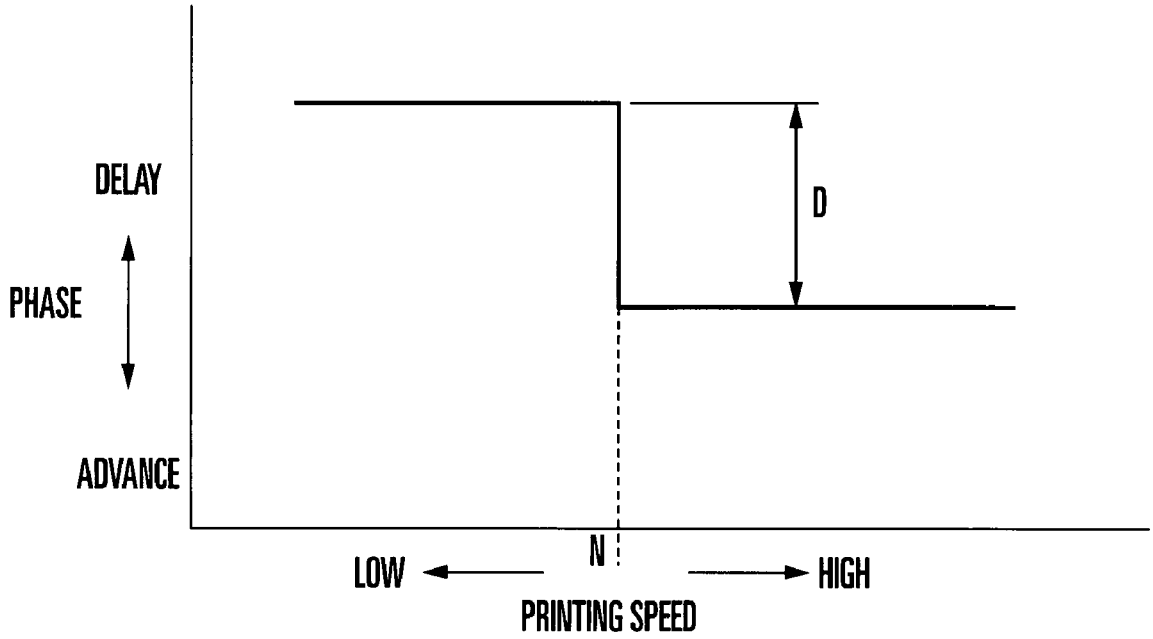
FIG. 9 is a graph showing the relationship between the printing speed and the operation start timings (phases) of an air controller and guide member switching device in the sheet delivery/guide apparatus according to the present invention.

The guide solenoid valve 31 switches from OFF to ON at a phase C1 which is delayed from the phase B1 and earlier than the phase C2 in FIG. 5B by a time t2 (FIG. 4B). Thus, the guide members 25 also move from the retreat position to the guide position at a timing which is earlier by the time t2 than in the case in which the printing speed is equal to or lower than the preset speed, while taking the time T2 since the phase C1 (FIG. 4A). Therefore, in the case of switching piling of the sheets 12 on the first pile 7 to that on the second pile 8, as shown in FIG. 9, when the printing speed increases from the low state through a preset speed N, the operation start periods (phases) of the air controller 24 and guide member switching device 32 advance by a phase difference D.

At this time, assume that the preset speed N satisfies, e.g., N=8,000 sheets/hr. The preset speed is not limited to satisfy N=8,000 sheets/hr. The operation time T2 of the guide actuator is constant regardless of the printing speed. Hence, to actuate the guide members at a timing matching the printing speed, the operation start period of the guide actuator is adjusted (to be advanced when the speed increases), thereby completing the operation of the guide actuator at the right timing.

Operation in a case in which piling of the sheets 12 on the second pile 8 switches to that on the first pile 7 will be described with reference to FIGS. 6A to 6E and 7A to 7E. When the printing speed is equal to or lower than the preset speed (FIGS. 7A to 7E), the sheet release cam solenoid valve 11 switches from OFF to ON at a phase D1, and the movable sheet release cam 10 enters the traveling path of the delivery grippers 6, thus switching to the first mode (FIG. 7E).

The fan shielding plate solenoid valve 23 is switches from ON to OFF at a phase E2 delayed from the phase D1 (FIG. 7D). Then, the fan shielding plate 22 opens the shielded air intake port of the first blower 20 while taking the time T1 since the phase E2 (FIG. 7C). The guide solenoid valve 31 switches from ON to OFF at a phase F2 slightly earlier than the phase E2 (FIG. 7B), and the guide members 25 move from the guide position to the retreat position while taking the time T2 since the phase F2 (FIG. 7A). Since T2>T1, the movement completion period of the guide members 25 to the retreat position is set to be delayed from the opening operation completion period of the fan shielding plate 22. Thus, the sheet 12 is blown with the wind from the first blower 20 before the guide members 25 complete moving to the retreat position, so it quickly falls onto the first pile 7.

When the printing speed is no longer than the preset speed (FIGS. 6A to 6E), the sheet release cam solenoid valve 11 switches from OFF to ON at the same phase D1 as in FIG. 7E (FIG. 6E), and the movable sheet release cam 10 enters the traveling path of the delivery grippers 6, thus switching to the first mode. The fan shielding plate solenoid valve 23 switches from ON to OFF at a phase E1 which is delayed from the phase D1 and earlier than the phase E2 in FIG. 7D by a time t3 (FIG. 6D). Thus, the fan shielding plate 22 opens the shielded air intake port of the first blower 20 at a timing earlier by the time t3 than the case in FIG. 7D, while taking the time T1 since the phase E1 (FIG. 6C).

The operation time T1 of the fan shielding plate actuator (not shown) is constant regardless of the printing speed. Hence, to actuate the fan shielding plate 22 at a timing matching the printing speed, the operation start time of the fan shielding plate actuator (not shown) is adjusted (to be advanced when the speed increases), thereby completing the operation of the fan shielding plate actuator (not shown) at the right timing.

The guide solenoid valve 31 switches from ON to OFF at a phase F1 which is earlier than the phase E1 and than the phase F2 in FIG. 7B by a time t4 (FIG. 6B). Thus, the guide members 25 also move from the guide position to the retreat position at a timing which is earlier by a time t4 than in the case of FIG. 7A, while taking the time T2 since the phase F1 (FIG. 6A).

The operation time T2 of the guide actuator (not shown) is constant regardless of the printing speed. Hence, to actuate the guide members 25 at a timing that matches the printing speed, the operation start time of the guide actuator (not shown) is adjusted (to be advanced when the speed increases), thereby completing the operation of the guide actuator at the right timing.

Therefore, in the case in which piling of the sheets 12 on the first pile 7 switches to that on the second pile 8, as shown in FIG. 9, when the printing speed increases from the low state via the preset speed N, the operation start periods (phases) of the air controller 24 and guide member switching device 32 advance by the phase difference D. Also, the moving completion time of the guide members 25 to the retreat position is set to be delayed from the opening operation completion time of the fan shielding plate 22, in the same manner as in the case of FIGS. 4A to 4E and 5A to 5E.

More specifically, when releasing the sheet 12 held by the delivery grippers 6 so the sheet 12 falls onto the first pile 7, the controller 38 controls so that the sheet 12 is blown with the wind from the first blower 20. Simultaneously, the controller 38 controls so that the guide members 25 are positioned at the retreat position. When conveying the sheet 12 downward in the sheet convey direction through the first pile 7, the controller 38 controls so that the sheet 12 is not blown with the wind from the first blower 20. Simultaneously, the controller 38 controls the air controller 24 and guide member switching device 32 such that the guide members 25 are located at the guide position.

The controller 38 also controls the operation start periods of the air controller 24 and guide member switching device 32 in accordance with the speed of the delivery grippers 6 that matches the printing speed detected by the rotary encoder 35. More specifically, the controller 38 controls to advance the operation start periods of the air controller 24 and guide member switching device 32 when the speed of the delivery grippers 6 is no longer than the preset speed.

When performing switching from the first mode to the second mode, the controller 38 controls so that the guide members 25 are positioned at the guide position after setting the sheet 12 not to be blown with the wind from the first blower 20. When performing switching from the second mode to the first mode, the controller 38 controls the air controller 24 and guide member switching device 32 so that the guide members 25 are positioned at the retreat position after setting the sheet 12 to be blown with the wind from the first blower 20.

Therefore, when performing switching from the first mode to the second mode, the controller 38 controls the air controller 24 and guide member switching device 32 such that the operation of the guide member switching device 32 is completed after the operation of the air controller 24 is completed. When performing switching from the second mode to the first mode, the controller 38 controls the air controller 24 and guide member switching device 32 such that the operation of the guide member switching device 32 is completed after the operation of the air controller 24 is completed.

Figure 8A:
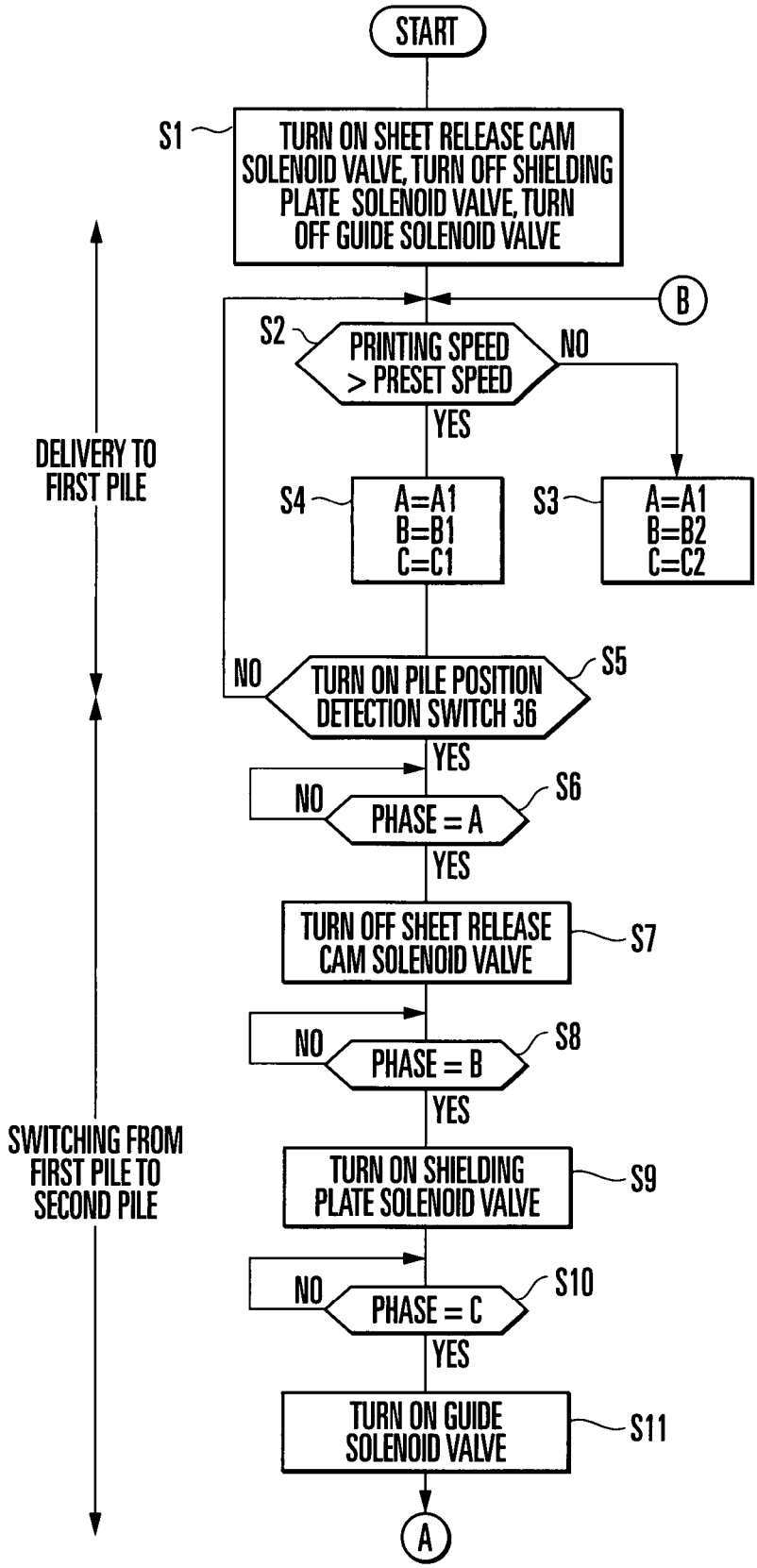
FIGS. 8A and 8B are flowcharts for explaining the switching operation between the first and second piles in the sheet delivery/guide apparatus shown in FIG. 1.
Figure 8B:
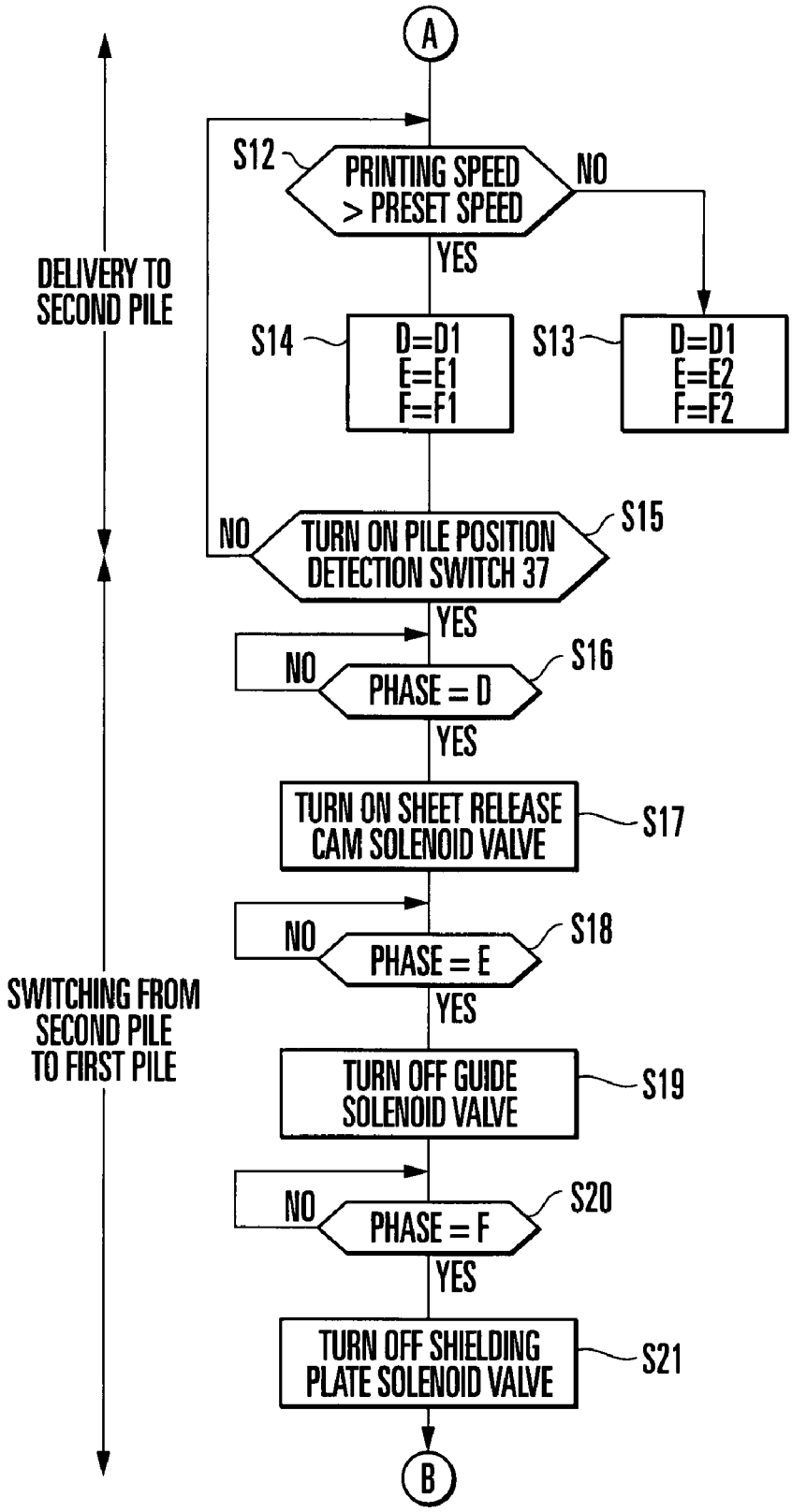

Delivery control and delivery switching control by the controller 38 will be described mainly with reference to FIGS. 8A and 8B. In FIGS. 8A and 8B, the delivery operation of the sheet 12 onto the first pile 7, the delivery switching operation from the first pile 7 to the second pile 8, the delivery operation of the sheet 12 onto the second pile 8, and the delivery switching operation from the second pile 8 to the first pile 7 will be described.

In step S1, the sheet release cam solenoid valve 11 is turned on, and the movable sheet release cam 10 enters the traveling path of the gripper bar having the delivery grippers 6, thus setting the first mode. The fan shielding plate solenoid valve 23 is turned off, so the fan shielding plate 22 opens the air intake port of the first blower 20. Thus, the sheet 12 passing the first pile 7 is blown with the wind from the first blower 20. Also, the guide solenoid valve 31 is turned off, so the guide members 25 move to the retreat position.

In this state, the cam follower of the gripper bar having the delivery grippers 6 that grip and convey the sheet 12 abuts against the cam surface of the movable sheet release cam 10, so the sheet 12 gripped by the delivery grippers 6 is released and falls onto the first pile 7. At this time, the sheet 12 falling onto the first pile 7 is blown with the wind from the first blower 20, and the guide members 25 have moved to the retreat position. Thus, the sheet 12 will not come into contact with the guide members 25 to be wrinkled, damaged, or rubbed, or the sheet 12 which is to pile on the first pile 7 will not ride over the guide members 25. Hence, the sheet 12 falls onto the first pile 7 and piles there quickly and reliably by the window blowing from the first blower 20.

Then, the printing speed detected by the rotary encoder 35 is compared with the preset speed (step S2). If the printing speed is equal to or lower than the preset speed (NO in step S2), a phase A at which the movable sheet release cam 10 switches from the first mode to the second mode is set to satisfy A=A1 (step S3). Simultaneously, a phase B at which the shielding plate solenoid valve 23 switches from OFF to ON is set to satisfy B=B2, and a phase C at which the guide solenoid valve 31 switches from OFF to ON is set to satisfy C=C2.

If the printing speed is faster than the preset speed (YES in step S2), the phase A at which the movable sheet release cam 10 switches from the first mode to the second mode is set to satisfy A=A1 (step S4). Simultaneously, the phase B at which the fan shielding plate solenoid valve 23 switches from OFF to ON is set to satisfy B=B1 (B1<B2), and the phase C at which the guide solenoid valve 31 switches from OFF to ON is set to satisfy C=C1 (C1<C2).

The state of the pile position detection switch 36 of the first pile 7 is checked (step S5). If the pile position detection switch 36 is OFF (NO in step S5), the procedure returns to step S2.

It is then checked whether the first pile 7 is fully piled with the sheets 12 and has moved downward to the lower limit so that the pile position detection switch 36 is ON (step S5). If the pile position detection switch 36 is ON, it is checked whether the machine phase detected by the machine phase detector 34 is the phase A set in step S3 or S4 (step S6). If the machine phase is the preset phase A (YES in step S6), the sheet release cam solenoid valve 11 is turned off and the movable sheet release cam 10 retreats from the traveling path of the gripper bar having the delivery grippers 6, thus setting the second mode (step S7).

When the machine phase detected by the machine phase detector 34 is the phase B set in step S3 or S4 (YES in step S8), the fan shielding plate solenoid valve 23 is turned on, so the fan shielding plate 22 shields the air intake port of the first blower 20 (step S9). When the machine phase is the phase C set in step S3 or S4 (YES in step S10), the guide solenoid valve 31 is turned on, and the guide members 25 move to the guide position (step S11).

In the second mode, the movable sheet release cam 10 has retreated from the traveling path of the delivery grippers 6. Thus, when the gripper bar having the delivery grippers 6 passes the movable sheet release cam 10, the cam follower of the delivery grippers 6 does not abut against the cam surface of the movable sheet release cam 10. Therefore, the sheet 12 gripped by the delivery grippers 6 does not fall onto the first pile 7, but is conveyed to the second pile 8 located downstream in the sheet convey direction (direction of the arrow A) of the first pile 7 while being gripped by the delivery grippers 6.

At this time, as the fan shielding plate 22 shields the air intake port of the first blower 20, the sheet 12 gripped and conveyed by the delivery grippers 6 passes the first pile 7 without being blown with the wind from the first blower 20. Hence, the trailing edge of the sheet 12 under conveyance will not move uncontrollably to result in damage or rub.

As the guide members 25 have moved to the guide position, the sheet 12 to be conveyed to the second pile 8 is guided while the guide members 25 are in contact with the trailing edge of the sheet 12. Hence, the trailing edge of the sheet 12 will not move uncontrollably to result in damage or rub. After that, when the gripper bar having the delivery grippers 6 passes the stationary sheet release cam 14, the cam follower abuts against the cam surface of the stationary sheet release cam 14. The sheet 12 is released from the delivery grippers 6 and accordingly falls onto the second pile 8. The leading edge of the falling sheet 12 abuts against the lays 19, so the sheet 12 piles on the second pile 8 such that it is aligned in the sheet traveling direction. In this manner, piling of the sheet 12 on the first pile 7 switches to that on the second pile 8.

If the printing speed is no longer than the preset speed in step S2, in step S4, the phase B is set to satisfy B=B1 and the phase C is set to satisfy C=C1. The phase B1 is set to be relatively earlier than the phase B2, in which the printing speed is equal to or lower than the preset seed, by the time t1, as shown in FIG. 4D. This effects control that advances the timing of the fan shielding plate 22 to shield the air intake port of the first blower 20, and advances the operation start period of the air controller 24 to perform switching from the state in which the sheet 12 is blown with the wind from the first blower to the state in which it is not.

The phase C1 is set relatively earlier than the phase C2, in which the printing speed is equal to or lower than the preset speed, by the time t2, as shown in FIG. 4B. This effects control that advances the timing of the guide members 25 to move from the retreat position to the guide position, thus advancing the operation start period of the guide member switching device 32. Therefore, even if the printing speed becomes no longer than the preset speed and the time interval of the sheets 12 conveyed by the delivery grippers 6 decreases, before the sheet 12 which is to be switched to pile on the second pile 8 from on the first pile 7 passes the first pile 7, switching takes place to the state in which the sheet 12 is not blown with the wind from the first blower 20, and the guide members 25 end moving to the guide position.

Therefore, the sheet which is switched to pile on the second pile 8 from on the first pile 7 does not erroneously fall onto the first pile 7 but can be reliably conveyed to the second pile 8 by the guide members 25. The wind does not blow the sheet 12 being guided by the guide members 25, and accordingly the sheet 12 does not move uncontrollably. Thus, the sheet 12 will not be wrinkled or rubbed.

As described with reference to FIGS. 4A, 4C, 5A, and 5C, control takes place such that the guide members 25 are positioned at the guide position after the fan shielding plate 22 shields the air intake port of the first blower 20. More specifically, when performing switching from the first mode to the second mode, the controller 38 controls the air controller 24 and guide member switching device 32 such the operation of the guide member switching device 32 is completed after the operation of the air controller 24 is completed.

In this manner, when performing switching from the first mode to the second mode, control takes place such that the guide members 25 are positioned at the guide position after setting the sheet 12 not to be blown with the wind from the first blower 20. As the sheet 12 is not conveyed while being urged against the guide members 25 with the wind from the first blower 20, the sheet 12 will not be damaged or rubbed.

After piling of the sheets 12 on the first pile 7 switches to that on the second pile 8, while the sheets 12 continue to pile on the second pile 8, the printing speed detected by the rotary encoder 35 is compared with the preset speed (step S12). If the printing speed is equal to or lower than the preset speed (NO in step S12), the phase D at which the movable sheet release cam 10 switches from the second mode to the first mode is set to satisfy D=D1 (step S13). Simultaneously, the phase E at which the fan shielding plate solenoid valve 23 switches from ON to OFF is set to satisfy E=E2, and the phase F at which the guide solenoid valve 31 switches from ON to OFF is set to satisfy F=F2.

If the printing speed is no longer than the preset speed (YES in step S12), the phase D at which the movable sheet release cam 10 switches from the first mode to the second mode is set to satisfy D=D1 (step S14). Simultaneously, the phase E at which the fan shielding plate solenoid valve 23 switches from ON to OFF is set to satisfy E=E1 (E1<E2), and the phase F at which the guide solenoid valve 31 switches from ON to OFF is set to satisfy F=F1 (F1<F2).

Whether or not the pile position detection switch 37 of the second pile 8 is ON is checked (step S15). If the pile position detection switch 37 is OFF (NO in step S15), the procedure returns to step S12.

It is then checked whether the second pile 8 is fully piled with the sheets 12 and has moved downward to the lower limit so that the pile position detection switch 37 is ON (step S15). If the pile position detection switch 37 is ON, it is checked whether the machine phase detected by the rotary encoder 35 is the phase D set in step S13 or S14 (step S16). If the machine phase is the preset phase D (YES in step S16), the sheet release cam solenoid valve 11 is turned on, and the movable sheet release cam 10 enters the traveling path of the gripper bar having the delivery grippers 6, thus setting the first mode.

When the machine phase detected by the machine phase detector 34 is the phase E set in step S13 or S14 (YES in step S18), the shielding plate solenoid valve 23 is turned off to open the air intake port of the first blower 20 which has been shielded by the fan shielding plate 22 (step S19). When the machine phase is the phase F set in step S13 or S14 (YES in step S20), the guide solenoid valve 31 is turned off, and the guide members 25 move to the retreat position (step S21).

As the air intake port of the first blower 20 is open, the sheet 12 under conveyance as it is gripped by the delivery grippers 6 is blown with the wind from the first blower 20. In the first mode, the movable sheet release cam 10 has entered the traveling path of the gripper bar having the delivery grippers 6. Thus, when the delivery grippers 6 pass the movable sheet release cam 10, the cam follower of the delivery grippers 6 abuts against the cam surface of the movable sheet release cam 10. Therefore, the sheet 12 gripped by the delivery grippers 6 is released and falls onto the first pile 7. Hence, piling of the sheet 12 on the second pile 8 switches to that on the first pile 7.

At this time, as the sheet 12 falling onto the first pile 7 does not come into contact with the guide members 25 that have retreated from the first pile 7, the sheet 12 will not be damaged or rubbed. The leading edge of the sheet 12 which has fell onto the first pile 7 abuts against the lays 18, so the sheet 12 piles on the first pile 7 such that it is aligned in the sheet traveling direction. The first blower 20 blows the sheet 12 to quickly fall onto the first pile 7.

If the printing speed is no longer than the preset speed in step S12, in step S14, the phase E in which the fan shielding plate solenoid valve 23 switches from ON to OFF is set to satisfy E=E1, and the phase F in which the guide solenoid valve 31 switches from ON to OFF is set to satisfy F=F1.

The phase E1 is set relatively earlier than the phase E2, in which the printing speed is equal to or lower than the preset seed, by the time t3, as shown in FIG. 6D. This effects control that advances the timing of the opening operation for the air intake port of the first blower 20, and advances the operation start period of the air controller 24 to perform switching from the state in which the sheet 12 is not blown with the wind from the first blower to the state in which it is.

The phase F1 is set relatively earlier than the phase F2, in which the printing speed is equal to or lower than the preset speed, by the time t4, as shown in FIG. 6B. This effects control that advances the timing of the guide members 25 to move from the guide position to the retreat position, thus advancing the operation start period of the guide member switching device 32.

Therefore, even if the printing speed becomes no longer than the preset speed and the time interval of the sheets 12 conveyed by the delivery grippers 6 decreases, before the sheet 12 which is to be switched to pile on the second pile 7 from on the first pile 8 is released from the delivery grippers 6 and its leading edge abuts against the lays 18, switching takes place to the state in which the sheet 12 is blown with the wind from the first blower 20, and the guide members 25 end moving to the retreat position.

Therefore, the sheet 12 which is switched to pile on the first pile 7 from the second pile 8 is not erroneously conveyed to the second pile 8, and the nonuniform piling state of the sheet 12 can be reliably prevented. As the sheet 12 to pile on the first pile 7 does not come into contact with the guide members 25, the sheet 12 will not be wrinkled or rubbed.

As described with reference to FIGS. 6A, 6C, 7A, and 7C, control takes place such that the guide members 25 are positioned at the retreat position after opening the air intake port of the blower 20. More specifically, when performing switching from the second mode to the first mode, the controller 38 controls the air controller 24 and guide member switching device 32 such the operation of the guide member switching device 32 is completed after the operation of the air controller 24 is completed.

In this manner, when performing switching from the second mode to the first mode, the guide members 25 are positioned at the retreat position after setting the sheet 12 to be blown with the wind from the first blower 20. As a result, the sheet 12 to pile on the first pile 7 can fall onto the first pile 7 reliably and quickly.

Figure 10:
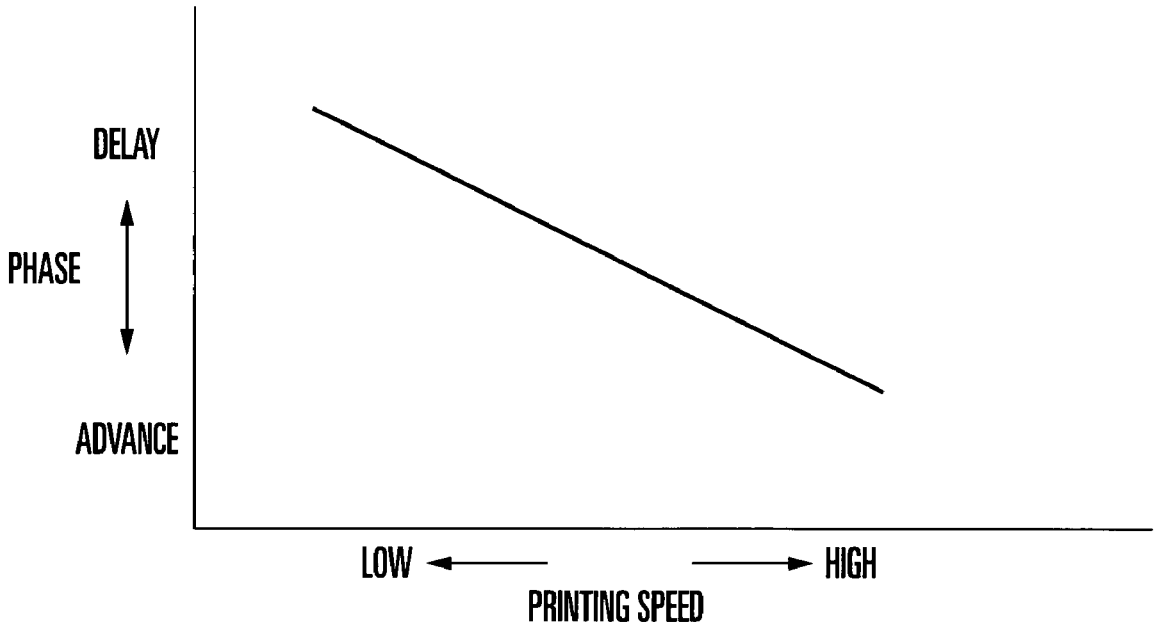
FIG. 10 is a graph showing the relationship between the printing speed and the operation start timings (phases) of an air controller and guide member switching device in a sheet delivery/guide apparatus according to the second embodiment of the present invention.

The second embodiment of the present invention will be described with reference to FIG. 10. FIGS. 1 to 3 of the first embodiment are employed in the second embodiment, and a repetitive description thereof will be omitted. In the first embodiment described above, a preset speed N is set, and each of the operation start periods (phases) of the air controller 24 and guide member switching device 32 is set to include two levels with the preset speed N intervened in between.

In contrast to this, according to the second embodiment, the printing speed and the operation start periods (phases) of an air controller 24 and guide member switching device 32 are set to establish a linear relationship, that is, such that when the printing speed increases, the phases advance proportionally. Hence, according to the second embodiment, when compared to the first embodiment, the operation start periods (phases) of the air controller 24 and guide member switching device 32 with respect to the printing speed are set more finely. This can switch piling of sheets 12 from on a first pile 7 to on a second pile 8 and vice versa at a more optimal timing.

In the embodiments described above, the sheet 12 that has passed the first pile 7 piles on the second pile 8. Alternatively, the sheet 12 that has passed the first pile 7 does not pile on the second pile 8 but is conveyed by a conveyor belt or the like, or is extracted as a sample sheet. In this case, the second pile 8 becomes unnecessary.

The time T2 required for the guide members 25 to move is longer than the time T1 required for the fan shielding plate 22 to move. Thus, the operation start period of the guide members 25 is set to be earlier than that of the fan shielding plate 22. Note that if T2≦T1, the operation start period of the fan shielding plate 22 can be earlier than that of the guide members 25. It suffices if the operation completion period of the fan shielding plate 22 is earlier than that of the guide members 25.

In the air controller 24, the shielding plate 22 shields/opens the air intake port of the first blower instantaneously. However, the present invention is not limited to this, and the shielding plate can shield/open the blowing port of the fan. Also, the first blower can comprise a large number of fans the rotation of which is started and stopped instantaneously by an air controller. In this case, the shielding plate becomes unnecessary.

The air controller and guide member switching device employ hydropneumatic cylinders having constant operation speeds, and their operation start periods are controlled in accordance with the speed of the printing press. However, the present invention is not limited to this. Actuators such as motors having variable operation speeds may be employed, and the operation speeds may be controlled in accordance with the printing speed of the printing press.

In each of the above embodiment, the sheet delivery/guide apparatus 1 is employed as the delivery apparatus of the sheet-fed rotary printing press. However, the present invention is not limited to this. For example, the sheet delivery/guide apparatus 1 can be employed as a coating apparatus or an inspection apparatus which inspects the printing quality of a sheet. Although the sheet 12 is used as the sheet, a film-type sheet or an aluminum plate can be used as the sheet.

As has been described above, according to the present invention, when the sheet convey speed is switched from a low speed to a high speed, the moving timing of the guide members and the timing to start and stop blowing of the blower can be controlled in an optimal manner. When switching takes place from a state in which the sheet piles on a piling means to a state in which the sheet passes the piling means, the timing to stop blowing and the timing of the guide members to move to the guide position are not delayed. Consequently, a passing sheet will not erroneously fall onto the pile device, but can be reliably conveyed downstream in the sheet convey direction of the pile device by the guide members. As the wind will not blow the sheet being guided by the guide members, the sheet will not move uncontrollably, and accordingly will not be wrinkled or rubbed.

When switching takes place from the state in which the sheet passes the pile device to the state in which the sheet piles on the pile device, the timing to start blowing and the timing of the guide members to move to the retreat position are not delayed. This can prevent the sheets from misalignment on the pile device due to a delay in the timing to start blowing. This can also prevent the sheet from rubbing against the guide members due to a delay in the timing of the guide members to move to the retreat position, so the sheet will not be rubbed or damaged.

What is claimed is:

1. A sheet delivery/guide apparatus comprising:

a convey device which holds and conveys a sheet;

a first pile device on which the sheet released from said convey device piles;

a first blowing device which is arranged above said first pile device and blows toward said first pile device;

air control means for selectively performing switching between an air supply state of supplying the sheet with on air and an air supply stop state of stopping the air supply for the sheet;

a guide member which is supported movably and guides the sheet that passes said first pile device while being held by said convey device;

guide member switching means for switching said guide member between a guide position to enter a sheet falling path, extending from said convey device to said first pile device, to guide the sheet, and a retreat position to retreat from said sheet falling path;

control means for controlling said air control means and said guide member switching means on the basis of a convey speed of said convey device, so that in a first mode in which the sheet piles on said first pile device, the air supply state of said first blowing device is effected and said guide member is positioned at the retreat position, and in a second mode in which the sheet passes said first pile device and is conveyed downstream in a sheet convey direction, the air supply stop state of said first blowing device is effected and said guide member is positioned at the guide position;

speed detection means for detecting a rotational speed of a machine corresponding to the convey speed of said convey device; and phase detection means for detecting a phase of said machine, wherein the control means controls operation start timings of the air control means and the guide member switching means in accordance with outputs of the speed detection means and the phase detection means.

2. An apparatus according to claim 1, wherein when a convey speed of said convey device is no longer than a predetermined speed, said control means controls to advance the operation start timings of said air control means and said guide member switching means to be earlier than a predetermined timing.

3. An apparatus according to claim 2, wherein when a convey speed of said convey device is no longer than a predetermined speed, said control means controls to advance the operation start timing of said air control means to be earlier than the predetermined timing by a first preset time and advance the operation start timing of said guide member switching means to be earlier than the predetermined timing by a second preset time.

4. An apparatus according to claim 2, wherein said control means controls said air control means and said guide member switching means such that when switching is to take place from the first mode to the second mode, air supply from said first blowing device stops, and thereafter said guide member is positioned at the guide position, and when switching is to take place from the second mode to the first mode, air is supplied from said first blowing device for the sheet, and thereafter said guide member is positioned at the retreat position.

5. An apparatus according to claim 2, wherein said control means controls said air control means and said guide member switching means such that when switching is to take place from the first mode to the second mode, operation of said air control means is completed, and thereafter operation of said guide member switching means is completed.

6. An apparatus according to claim 2, wherein said control means controls said air control means and said guide member switching means such that when switching is to take place from the second mode to the first mode, operation of said air control means is completed, and thereafter operation of said guide member switching means is completed.

7. An apparatus according to claim 1, wherein said control means controls such that when the convey speed of said convey device increases, the operation start timings of said air control means and said guide member switching means advance in proportion to the convey speed of said convey device.

8. An apparatus according to claim 1, further comprising a second pile device on which a sheet passing said first pile device, released from said convey device piles, and a second blowing device which is arranged above said second pile device and blows toward said second pile device.

9. An apparatus according to clam 8, wherein in the second mode, the sheet released from said convey device piles on said second pile device.

10. An apparatus according to claim 9, further comprising a first detector which detects a piling state of said pile device, and a second detector for detecting a piling state of said second pile device, wherein said control device performs switching between the first mode and the second mode on the basis of detection outputs from said first detector and said second detector.

11. An apparatus according to claim 1, wherein when said guide member moves from the retreat position to the guide position, said guide member moves upstream in the sheet convey direction.

12. An apparatus according to claim 1, wherein said first blowing device comprises a fan, and said air control means comprises a shielding plate which shields an air intake port of said fan.

13. An apparatus according to claim 1, wherein the operation times of said air control means and said guide member switching means are constant regardless of the sheet convey speed.

* * * * *